US006125894A

United States Patent [19]

Fritze et al.

[11] Patent Number: 6,125,894

[45] Date of Patent: Oct. 3, 2000

[54] ELECTRIC VERSION FRY DISPENSER

[75] Inventors: Karl Jon Fritze, Denmark Township; Kirby Juhl Kuhlemeier, Cottage Grove; Ferdinand Joseph Herpers, Minnetonka; Bruce Hamilton Koerner, Red Wing, all of Minn.

[73] Assignee: Robot Aided Manufacturing Center, Inc., Red Wing, Minn.

[21] Appl. No.: 09/152,232

[22] Filed: Sep. 11, 1998

[51] Int. Cl.[7] ..... B65B 1/04

[52] U.S. Cl. ..... 141/83; 141/168; 141/172

[58] Field of Search ..... 141/18, 2, 129, 141/83, 168, 172, 275; 99/407; 177/114; 222/56

[56] References Cited

U.S. PATENT DOCUMENTS

| | | |
|---|---|---|
| D. 337,021 | 7/1993 | Boetto et al. . |
| D. 402,853 | 12/1998 | Fritze et al. . |
| 3,456,748 | 7/1969 | Allen et al. . |
| 3,985,266 | 10/1976 | Wright, Jr. . |
| 4,922,435 | 5/1990 | Cahlander et al. . |
| 4,979,864 | 12/1990 | Cahlander et al. . |
| 5,104,002 | 4/1992 | Cahlander et al. . |
| 5,132,914 | 7/1992 | Cahlander et al. . |
| 5,172,328 | 12/1992 | Cahlander et al. . |
| 5,191,918 | 3/1993 | Cahlander et al. . |
| 5,244,020 | 9/1993 | Bruno et al. . |
| 5,249,914 | 10/1993 | Cahlander et al. . |
| 5,282,498 | 2/1994 | Cahlander et al. . |
| 5,353,847 | 10/1994 | Cahlander et al. . |
| 5,778,767 | 7/1998 | Rudesill . |

FOREIGN PATENT DOCUMENTS

| | | |
|---|---|---|
| 0 455 477 A2 | 11/1991 | European Pat. Off. . |
| 0 488 351 A1 | 6/1992 | European Pat. Off. . |
| 830685 | 3/1957 | United Kingdom . |

OTHER PUBLICATIONS

Brochure, "RAM Center ARCH® Fry Dispenser", RAM Center Inc. of Red Wing, Minnesota, 2 pages (1994).

Brochure, "Introducing the new ARCH® Fry Dispenser", RAM Center Inc. of Red Wing, Minnesota, 2 pages (1995).

*Primary Examiner*—Steven O. Douglas
*Attorney, Agent, or Firm*—Merchant & Gould P.C.

[57] ABSTRACT

A electric version of a dispenser unit and method of monitoring a request signal for filling empty baskets, movement of the empty baskets on a loading ramp via a stop gate, and movement of the filled basket between a loading station and a staging station via a basket lift. The stop gate is driven by an electric motor, and the basket lift is driven by another electric motor. Sensors are mounted in the stop gate and the basket lift to indicate positions of the stop gate and the basket lift, respectively.

22 Claims, 13 Drawing Sheets

ELECTRIC VERSION FRY DISPENSER

FIELD OF THE INVENTION

This invention relates generally to a dispensing unit; more particularly to a food items dispensing unit; and more particularly still to an electrically controlled food items dispensing unit.

BACKGROUND OF THE INVENTION

Frozen french fry dispensers are known in the art. An example is disclosed in U.S. Pat. No. 5,282,498 issued to Cahlander et al; U.S. Pat. No. 5,353,847 issued to Cahlander et al; and U.S. Pat. No. 5, 191,918 issued to Cahlander et al. Each of the foregoing patents discloses a french fry dispenser which includes a main storage bin, a device for moving the fries from the main storage bin into a secondary location, a means for holding the fries in the secondary location, a pneumatic cylinder apparatus for stopping empty baskets until a load basket request is made; an apparatus for moving empty cooking baskets into a position under the secondary storage location; and a pneumatic cylinder apparatus for moving baskets filled with the fries to a staging area.

While the disclosed dispenser automates the process of dispensing frozen articles and has been successful in the marketplace, there are several areas in which the dispenser may be improved. First, the pneumatic cylinder apparatus used for stopping the plurality of empty baskets until a load basket request is made and the pneumatic cylinder apparatus for automatically moving the basket filled with the fries to a staging area are often not desired by the end users. Compressed air (or other fluid) generally drives the pneumatic cylinder. While a pneumatic cylinder apparatus is often used to move an item from one position to another position, a substantial amount of noise is created from the compressor. Also, the seals and/or hoses used in a pneumatic cylinder apparatus may leak because of wear and tear, aging or other defects. The compressor may also become overheated after extensive uses of the apparatus, causing the overload protection switch to open which would disable the dispensing unit from operating for minutes even to hours. Further, a pneumatic cylinder apparatus used in a fry dispenser generally requires a low pressure for safety reasons. Furthermore, in using a pneumatic cylinder apparatus for a fry dispenser, grease often leaks into the pneumatic part of the apparatus which requires periodic maintenance, e.g. requiring frequent adjustment for the pneumatic cylinders to maintain operation. This is one of the user's major concerns. Other issues of a pneumatic cylinder apparatus which cause the need for maintenance are wear and tear, and clogging due to shortening or other airborne contamination. And further yet, especially in a low pressure pneumatic cylinder apparatus, it is generally difficult to adjust/maintain the speed of movement.

Therefore, there arises a need in the art for an electric version of a dispenser apparatus which is capable of dispensing articles, such as frozen fries, in a similar manner but overcoming the above mentioned disadvantages. Such electric version of the dispenser apparatus should also provide for an accurate control without the need for periodic maintenance for a basket lift and a stop gate control, etc.

SUMMARY OF THE INVENTION

The present invention provides for a reliable method and apparatus for dispensing articles and controlling the movement of empty baskets or containers and filled baskets or containers. The movement of baskets or containers is controlled by electrically driven apparatuses.

In a preferred embodiment constructed according to the principles of the present invention, a dispensing unit includes a main storage area which can take the form of a bulk storage hopper, an accumulator area into which the dispensed articles are transferred during the "gravimetric" dispensing of the articles. What is meant by gravimetric is that a quantity of articles is transferred to the accumulator area, where the transferred mass is weighed.

The accumulator area may be formed from the same walls of the primary storage area. A means for controllably transferring articles from the primary to the accumulator area is also provided. The controllable transfer means may include a drum having a plurality (or series) of elevated areas about the circumference of the drum and a diverter shape located in the primary storage area. A drive means is provided to rotate the drum when transferring articles.

The articles in the accumulator area are retained in that area by a gate means. The gate means are selectively operated between open and closed positions. Weight sensing means are arranged and configured to weigh the articles retained by the gate means in real time. A controller monitors the real time signal of the weight sensing means and operates the drive means to control the articles dispensed into the accumulator area to a predetermined level. It will be appreciated that the gate means may be selectively opened automatically upon reaching the desired weight or may be operated by a user when desired.

One feature of the present invention is that by monitoring a request for filling a basket and the movement of the basket(s) on a loading ramp and/or between a loading area or station and a staging area or station, a controller can determine whether a basket should be released by a stop gate and/or a basket carrier or saddle should be lifted to the loading station or lowered to the staging station.

Therefore, according to one aspect of the invention, there is provided an electrically controlled apparatus for filling articles in at least one basket. The apparatus includes:

a) an electrically driven stop gate, wherein one basket can be held/released by the stop gate;

b) a first sensor set and a controller determining whether the stop gate opens or closes;

c) a second sensor set and the controller determining a position of the stop gate;

d) an electrically driven basket lift, wherein a basket carrier can be lifted/lowered by the basket lift between a loading station, whereby an empty basket released by the stop gate and carried by the basket carrier can be filled, and a staging station, whereby a filled basket carried by the basket carrier can be removed;

e) a third sensor set and the controller determining whether the articles should be dispensed; and f) a fourth sensor set and the controller determining whether the basket carrier should be lifted from the staging station to the loading station.

In one aspect of the invention, the basket lift is driven by a first electric motor, and the stop gate is driven by a second electric motor. A resting or standby position for the first electric motor is where the basket lift is in an extended position such that the basket carrier is in the loading station, and a resting or standby position for the second electric motor is where the stop gate is open. Accordingly, when an empty basket is placed on a loading ramp or guide, the basket slides onto the basket carrier to be filled. One advantage of this aspect of the invention is that it significantly saves time for filling an empty basket.

A further aspect of the invention is that the first motor maintains its motion/resting positions by using a proportional servo technique.

One aspect of the invention is that the basket lift includes a lift base, the first electric motor is mounted on the lift base; a lift coupling mounted on and rotatable by the first electric motor; and an extendable/retractable basket lift assembly connected to the lift coupling, such that the first electric motor is initially turned in one direction to extend the basket lift assembly in a pre-loading position, which lifts the basket carrier to the loading station. The first electric motor is in its resting or standby position. When a filling request is received, articles are dispensed in the empty basket, and the first electric motor is turned in an opposite direction. The basket lift assembly is retracted to bring the basket carrier to the staging station. After unloading the basket, the first motor may drive the basket lift assembly back to the pre-loading position to be ready for the next request whereby the stop gate opens.

Another aspect of the present invention is that the basket lift assembly includes an outer basket lift tube; an inner basket lift tube, which has an internally threaded member fastened at one end of the inner basket lift tube; an externally threaded rod corresponding with the internally threaded member and being disposed at a center of the basket lift assembly. The internally threaded member is arranged and configured such that the outer basket lift tube prevents rotation of the inner basket lift tube. When the externally threaded rod is rotated, the internally threaded member raises or lowers, depending on the direction of rotation of the externally threaded rod. Accordingly, the inner basket lift tube is extendable/retractable from/into the outer basket lift tube.

A further aspect of the present invention is that the externally threaded rod has one end extended out of the basket lift assembly and connected to the lift coupling, such that upon rotation of the lift coupling by the first electric motor, the externally threaded rod drives the inner basket lift tube to extend toward the loading station away from the outer basket lift tube, and upon rotation of the lift coupling by the first electric motor in the opposite direction, the externally threaded rod drives the inner basket lift tube to retract toward the staging station and into the outer basket lift tube.

In still another aspect of the present invention, the lift coupling includes a motor coupling block having a bore to retain a shaft of the first electric motor; a pin transversely disposed across walls of the motor coupling block, the pin is received by the end of the externally threaded rod; and a plate coupled to the motor coupling block such that the plate rotates with the motor coupling block, the plate having an indicator for indicating rotating positions of the motor coupling block such that extending/retracting of the inner basket lift tube along the outer basket lift tube is controlled. The motor coupling block of the lift coupling and the motor shaft each has a flattened portion which allows wobbling between the lift coupling and the motor shaft. The combination of the pin/rod arrangement and the motor coupling block/motor shaft arrangement provides a universal joint type of connection between the lift coupling and the basket lift assembly.

In another aspect of the present invention, the basket lift includes a housing for retaining the lift coupling, one end of the basket lift assembly, and at least one sensor for sensing the plate. The sensor arrangement can be a quadrature encoding arrangement.

In another aspect of the present invention, the basket lift includes a lock assembly which detachably locks the basket lift assembly with respect to the housing of the basket lift. The lock assembly is in a bent shape with one section mounted on the housing, and the other section having a V-shape which allows the lock assembly to contact an outer groove of the outer basket lift tube.

In another aspect of the present invention, the end of the externally threaded rod is in a U-shape, and the pin of the lift coupling is disposed inside the U-shaped end. This allows a longitudinal and transversal clearance between the basket lift assembly and the lift coupling. Therefore, one advantage of the present invention is that it significantly reduces binding due to eccentricity and/or misalignment between the externally threaded rod and the motor shaft and in turn significantly reduces damage thereto caused by the rotation of the motor.

One aspect of the present invention is that the stop gate includes a stop gate shaft which is connected to a motor shaft of the second electric motor; a stop gate flap for holding and releasing at least one empty basket, the stop gate flap is rotatable between a holding position and a releasing position; a stop gate tube assembly having a bore to retain the stop gate shaft and the motor shaft of the second electric motor; and at least one sensor for sensing the plate and the resultant stop gate position.

Another aspect of the present invention is that the second electric motor is arranged and configured such that the ratio of the gear box with respect to the motor driver is selected to minimize back driving of the motor shaft and to allow the stop gate flap to hold the empty baskets in the holding position without any power to the second electric motor.

Still another aspect of the present invention is that the second electric motor and the gear box are arranged and configured to perform a stopping function in the event of a disruption in electrical power to the dispensing unit.

A further aspect of the present invention is that the stop gate tube assembly includes a tube; a plate having an indicator indicating rotating positions of the stop gate tube assembly such that the positions of the flap are monitored; and a hard stop disk stopped by an obstacle which is disposed in a path of the hard stop disk for providing an initial or home position of the stop gate tube assembly. The hard stop disk and the obstacle may be replaced by a sensor for indicating the initial or home position of the stop gate tube assembly. For instance, the hard stop disk and the obstacle can function as a replacement or backup for a sensor to indicate a stop gate open position. The hard stop disk and the obstacle may also provide a hard stop for the excessive rotation of the stop gate tube assembly.

Another aspect of the present invention is that the stop gate housing retaining the other end of the stop gate tube assembly, the motor shaft of the second electric motor, and the at least one sensor.

According to another aspect of the invention, there is provided a method of filling at least one empty basket with articles upon a request signal, including:

a) receiving the request signal;

b) dispensing the articles into one empty basket at an article loading station;

c) closing a stop gate driven by a second electric motor;

d) lowering filled basket seated on a basket carrier from a loading station to a staging station by a basket lift driven by a first electric motor;

e) lifting the basket carrier by the basket lift, driven by the first electric motor, back to the loading station;

f) opening the stop gate driven by the second electric motor to release next empty basket; and g) moving the next empty basket onto the basket carrier to be filled.

One aspect of the present invention is that the step g) can be accomplished by gravity.

Another aspect of the present invention is that the method further includes h) conveying the filled basket away. The filled basket can be carried away by a staging conveyor or manually by hand. In one embodiment, the filled basket is carried away by a staging guide rack, and the filled basket is transferred on the staging rack by gravity.

A further aspect of the present invention is that the method further includes i) determining whether another request signal is received, if received, continuing b)–g).

An additional aspect of the present invention is that the request signal can be a result of a normal automated action signified by a sensor sensing an empty basket in the basket carrier or by a user's input.

Further, according to one aspect of the invention, there is provided an electrically driven lift apparatus, including:

a) an electric motor having a motor shaft;

b) a coupling mounted on the motor shaft and rotatable by the electric motor; and c) an extendable/retractable tube assembly connected to the coupling, wherein when the electric motor turns the coupling in one direction, the tube assembly is extended, and when the electric motor turns the coupling in an opposite direction, the tube assembly is retracted.

In one aspect of the invention, the apparatus includes a sensor for sensing a position of the tube assembly.

In an additional aspect of the invention, the tube assembly includes:

an outer tube;

an inner tube, which has an internally threaded member fastened at one end of the inner tube;

an externally threaded rod corresponding with the internally threaded member and being disposed at a center of the tube assembly; and wherein the internally threaded member is arranged and configured such that the outer tube prevents rotation of the inner tube, when the externally threaded rod is rotated, the internally threaded member raises or lowers, depending on the direction of rotation of the externally threaded rod, and the inner tube is extendable/retractable from/into the outer tube.

Another aspect of the invention is that the electric motor is a servo motor which maintains motion/resting positions of the tube assembly.

A further aspect of the present invention is that the externally threaded rod has one end extended out of the tube assembly and connected to the coupling, such that upon rotation of the coupling by the electric motor, the externally threaded rod drives the inner tube to extend from the outer tube, and upon rotation of the coupling by the electric motor in the opposite direction, the externally threaded rod drives the inner tube to retract into the outer tube.

In another aspect of the present invention, the coupling includes:

a motor coupling block having a bore to retain a shaft of the electric motor;

a pin transversely disposed across walls of the motor coupling block, the pin being received by the end of the externally threaded rod; and a plate coupled to the motor coupling block such that the plate rotates with the motor coupling block, the plate having an indicator indicating rotating positions of the motor coupling block such that extending/retracting of the inner tube along the outer tube is controlled.

Further in one aspect of the invention, the motor coupling block and the motor shaft each has a flattened portion which allows wobbling between the coupling and the motor shaft. The combination of the pin/rod arrangement and the motor coupling block/motor shaft arrangement provides a universal joint type of connection between the coupling and the tube assembly.

Furthermore, according to one aspect of the invention, there is provided an electrically driven stop gate apparatus, including:

a) an electric motor having a motor shaft;

b) a stop gate shaft which is connected to the motor shaft;

c) a stop gate flap, disposed at one end of the stop gate shaft, being rotatable between an open position and a close position; and d) a stop gate tube assembly having a bore to retain the stop gate shaft and the motor shaft of the electric motor.

In one aspect of the invention, the stop gate apparatus includes a sensor for sensing a position of the stop gate tube assembly.

Another aspect of the present invention is that the electric motor and the gear ratio are arranged and configured such that the friction in the gears suffices to hold the stop gate flap in the close position without any power to the electric motor.

A further aspect of the present invention is that the stop gate tube assembly includes:

a tube;

a plate having an indicator indicating rotating positions of the stop gate tube assembly such that positions of the flap are monitored; and a hard stop disk and an obstacle in a hard stop disk path providing a home position for rotation of the stop gate tube assembly.

While the invention will be described with respect to a preferred embodiment configuration and with respect to particular components, it will be understood that the invention is not to be construed as limited by such configurations or components. Further, while the preferred embodiment of the invention will be described in relation to dispensing articles such as frozen french fries and to the method applicable to using sensors for controlling the dispensing process at greater accuracy, it will be understood that the scope of the invention is not to be limited by this environment in which the preferred embodiment is described herein.

These and various other advantages and features which characterize the invention are pointed out with particularity in the claims annexed hereto and forming a part hereof. However, for a better understanding of the invention, its advantages and objectives obtained by its use, reference should be had to the drawings which form a further part hereof and to the accompanying descriptive matter, in which there is illustrated and described a preferred embodiment to the invention.

BRIEF DESCRIPTION OF THE DRAWINGS

Referring to the drawings wherein like numerals represent like parts throughout the several views.

DETAILED DESCRIPTION OF THE PREFERRED EMBODIMENT

The present invention provides for a reliable method and apparatus for dispensing articles and controlling the movement of empty baskets or containers and filled baskets or containers. The movement of baskets or containers is controlled by electrically driven apparatuses.

In the following description of the exemplary embodiment, reference is made to the accompanying drawings which form a part hereof, and in which is shown by way of illustration the specific embodiment in which the invention may be practiced. It is to be understood that other embodiments may be utilized when structural and other changes may be made without departing from the scope of the present invention.

Figure 1:
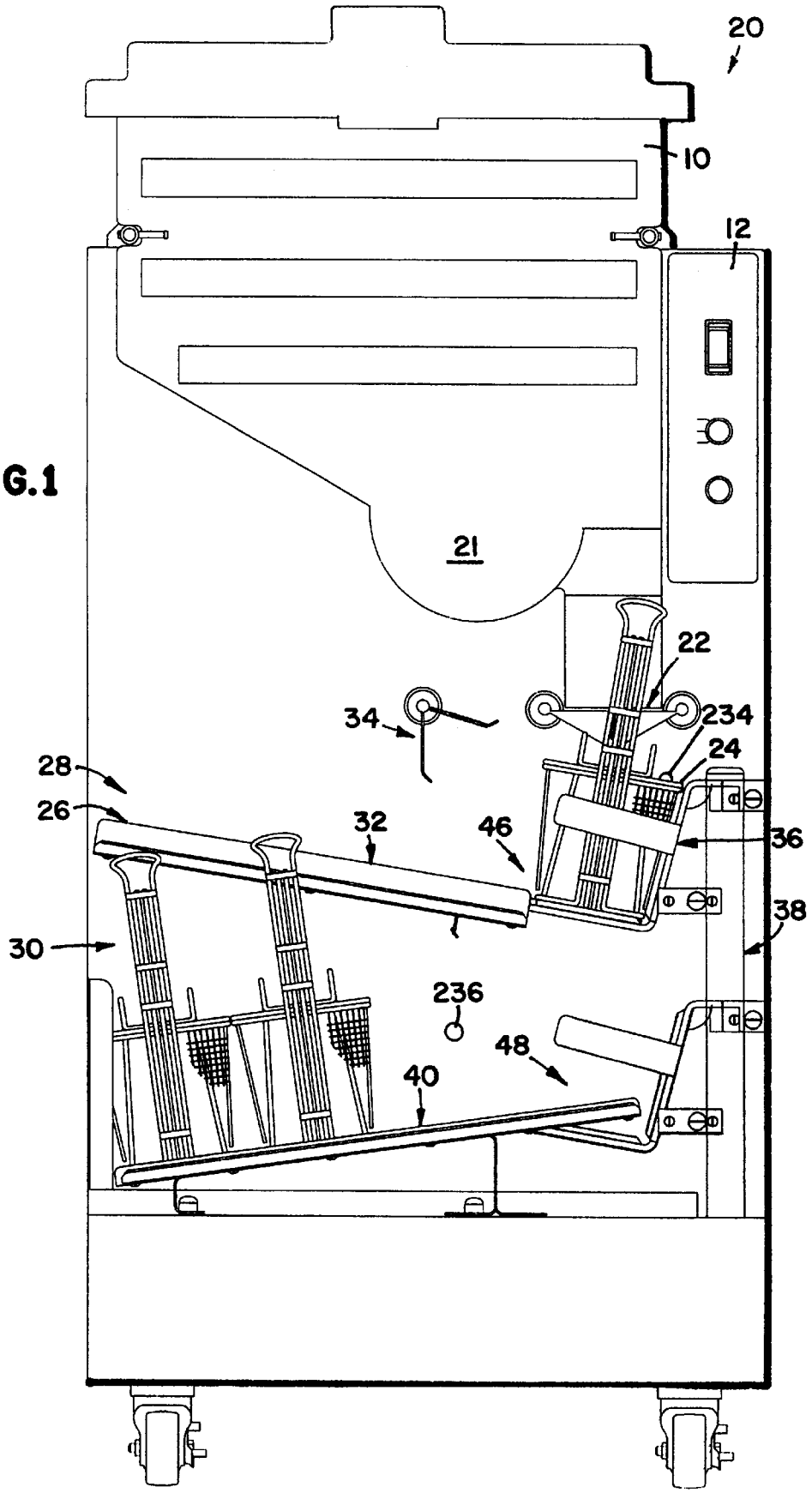
FIG. 1 is a front elevation view of one embodiment of an electric version of an article dispenser unit in accordance with the present invention.

Turning now to FIG. 1, there is illustrated a preferred movable dispenser unit designated by the number 20. The dispenser unit 20 includes a dispenser 21 which controllably dispenses articles via a dispensing door 22 to an empty basket 24, and a basket moving apparatus 26 which moves baskets from an empty basket loading area 28 to a filled basket removal area 30. The basket moving apparatus 26 comprises an inclined loading ramp 32, a stop gate 34, a basket carrier 36, a basket lift 38, and a staging ramp 40.

One or more empty baskets may be placed on the inclined loading ramp 32 at the empty basket loading area 28. The empty basket may slide down the loading ramp 32 by gravity onto a basket carrier at a loading area to be filled. The next basket in line is stopped by the stop gate 34. The stop gate 34 is normally open to allow one empty basket to slide onto the basket carrier. The stop gate 34 may rotate into a holding or close position as a result of a normal automated action signified by a sensor sensing that a request signal is received. Accordingly, an empty basket is allowed to slide into the basket carrier where it waits for the filling request signal. This significantly saves time for the filling operation.

An electric motor 42 (see FIG. 9) drives the stop gate 34 between an open position and a close position. The stop gate 34 holds or releases the basket. The details will be discussed later.

As shown in FIG. 1, the basket carrier 36 is supported by the basket lift 38. Further, the basket lift 38 lifts the basket carrier 36 to a loading station 46 to wait for a request-to-fill signal. An electric motor 44 (see FIG. 2) drives the basket lift 38 which lifts the basket carrier 36 to the loading station 46. Once the basket is filled, the basket lift 38 is driven to lower the filled basket to a staging station 48. After the unloading, the basket lift 38 may lift the basket carrier 36 back to the loading station to wait for the next request-to-fill signal.

Figure 2:
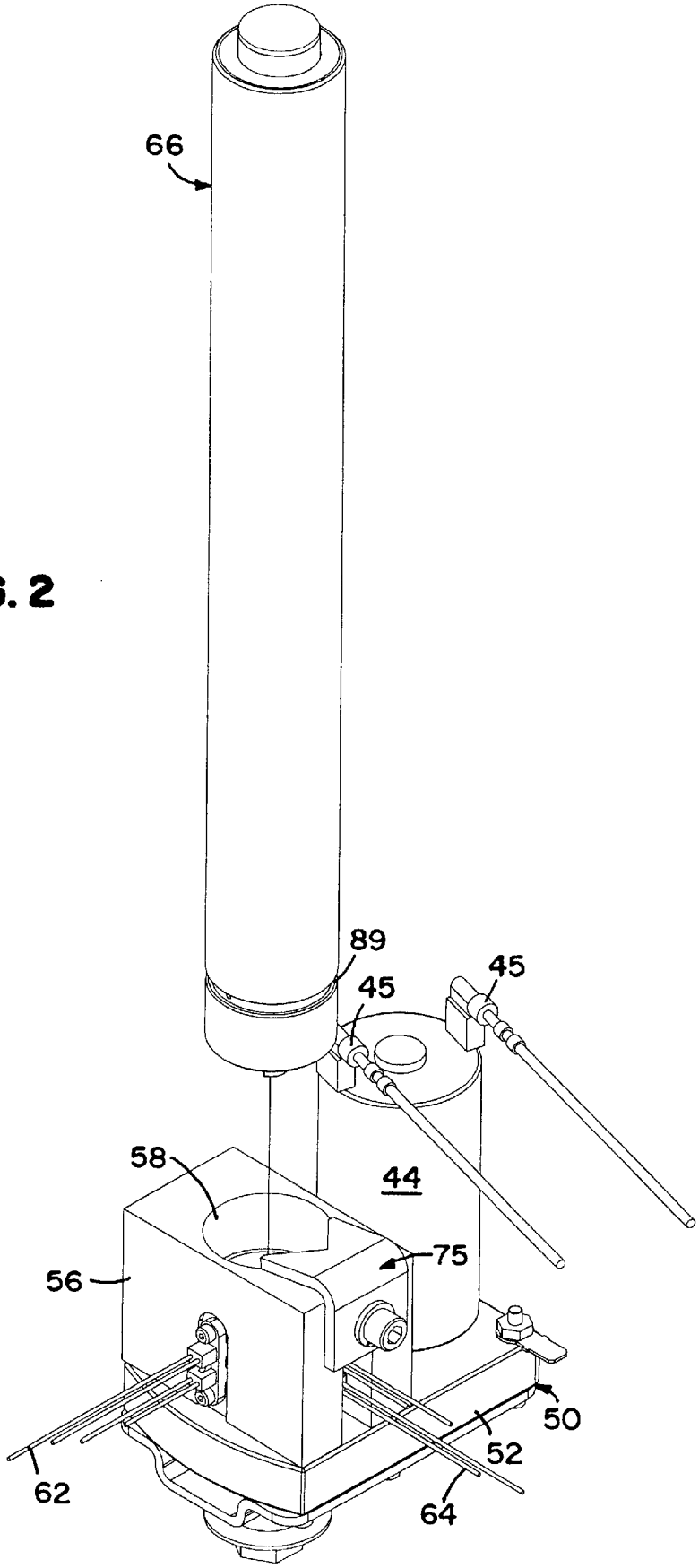
FIG. 2 is an exploded view of one embodiment of a basket lift in accordance with the present invention.

In FIG. 2, one embodiment of the basket lift 38 is shown in an exploded view. The electric motor 44 is mounted on a base lift 50. The motor 44 may be a DC motor known in the motor art. A gear box 52 is connected to the motor 44, and a motor shaft 54 (in FIG. 3) is enclosed in a housing 56. The housing 56 has a bore 58 for retaining the motor shaft 54, as well as a lift coupling 60 (in FIG. 3) and two sensors 62,64. The sensors 62,64 can be mounted on the housing 56 by screws 41,43 (in FIG. 3), respectively. It is appreciated that the sensors 62,64 can be any type of suitable sensors, such as optical encoder sensors, etc., within the scope of the present invention. It is also appreciated that the mounting mechanism of the sensors can be varied within the scope of the present invention. The basket lift 38 also includes a basket lift assembly 66 which is activated by the lift coupling 60. The basket lift assembly 66 may extend to proximate a full length when the electric motor 44 drives in one direction. The basket lift assembly 66 may also retract to proximate a shortest length when the electric motor 44 drives in an opposite direction. The basket lift assembly 66 maintains its length when the motor 44 is in a resting or standby position. The motor's resting or standby position can be accomplished by a servo activation of the motor 44 known in the motion control art. A pair of wire harness 45 brings the electricity to the motor 44.

Figure 3:
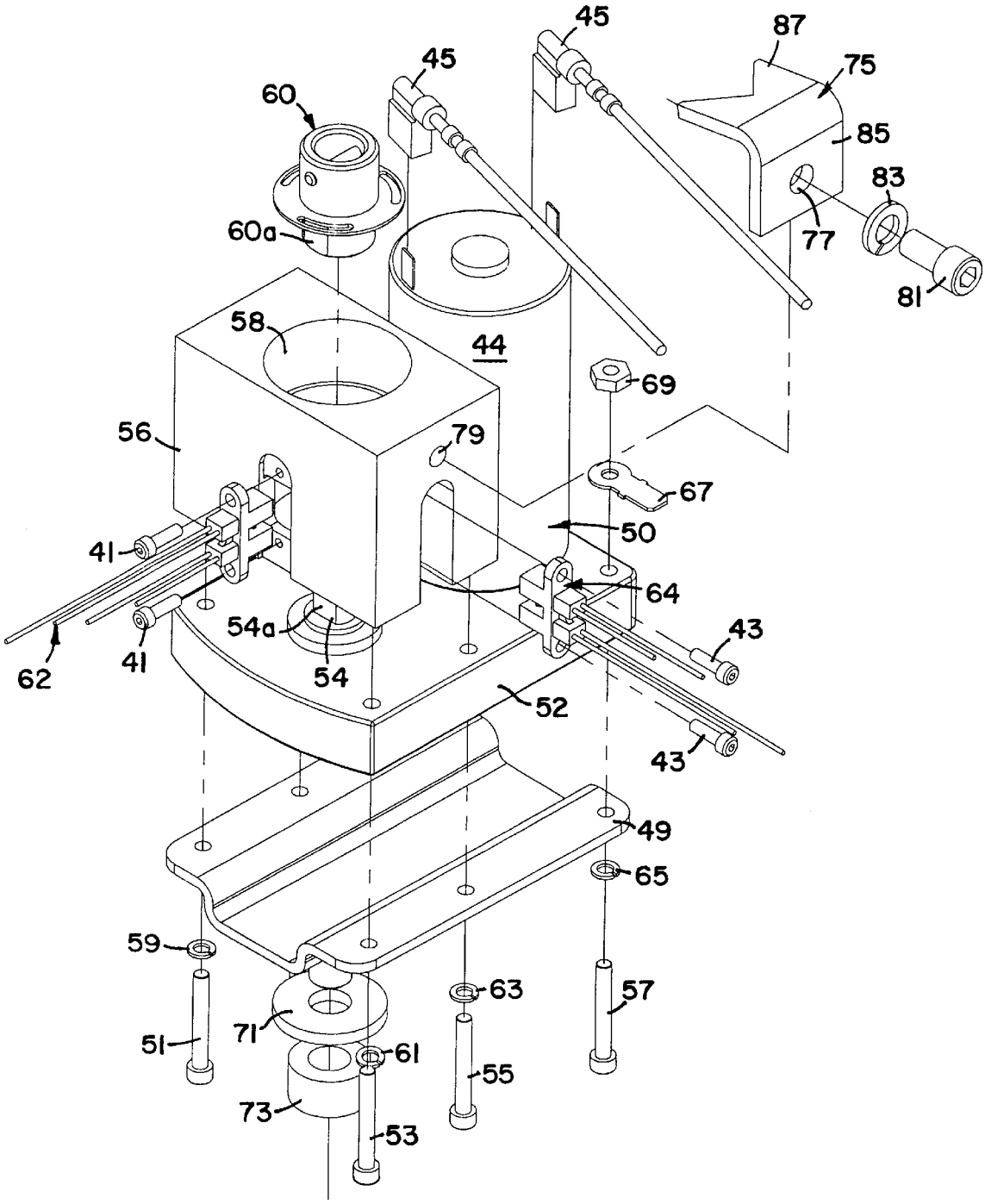
FIG. 3 is a partial, enlarged exploded view of one embodiment of a basket lift in accordance with the present invention.

In FIG. 3, a further exploded view of the base lift 50, the motor 44, the two sensors 62,64 mounted in the housing 56, and the lift coupling 60, is shown in a preferred embodiment. In addition, a basket lift mounting plate 49 may be mounted at the bottom of the gear box 52 by screws 51,53,55,57, washers 59,61,63,65, a terminal stud 67, and a nut 69. A pad 71 and a bushing 73 may also be attached to the bottom of the basket lift mounting plate 49. The pad 71 and the bushing 73 can be elastic so as to reduce vibration and provide a means of retention and scaling. In addition, a lock 75 may be mounted on the housing 56 via a hole 77 on the lock 75 and a hole 79 on the housing 56 by a screw 81 and a washer 83. The lock 75 can be in a bent shape with one section 85 mounted on the housing 56, and the other section 87 having generally a V-shape which allows the lock 75 to lock into an outer groove 89 (in FIGS. 2 and 5) of an outer basket lift tube 82.

Figure 4:
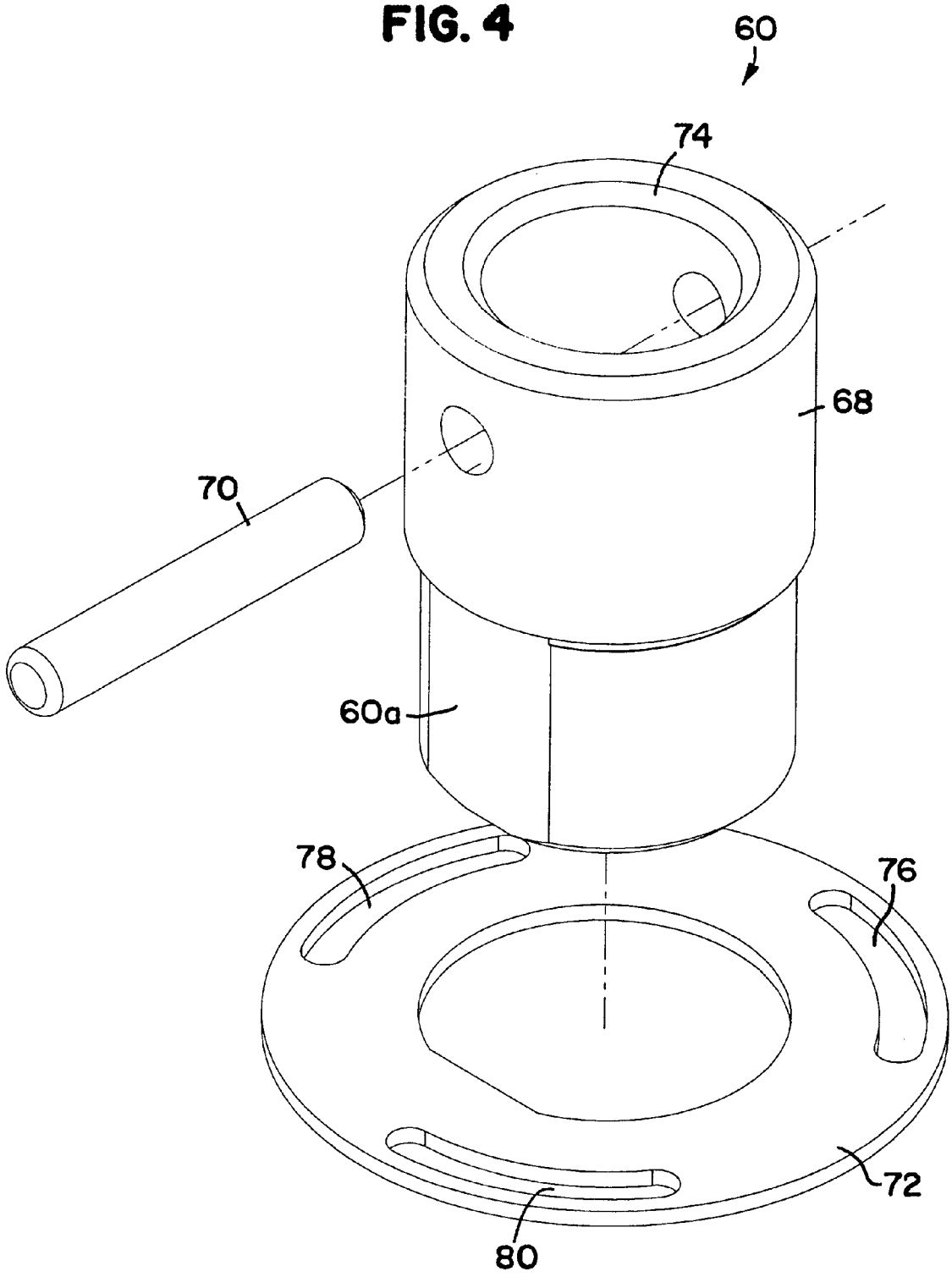
FIG. 4 is an exploded view of one embodiment of a lift coupling of the basket lift in accordance with the present invention.

The lift coupling 60 as shown in FIG. 4 may generally include a motor coupling block 68, a pin 70, and a plate 72.

The motor coupling block 68 has a bore 74 to retain the shaft 54 of the electric motor 44. The pin 70 is transversely disposed across walls of the motor coupling block 68 and is received inside the end of a rod 86 of the basket lift assembly 66. The motor coupling block 68 and the shaft 54 each has a flattened portion 60A,54A, respectively, which allows wobbling between the lift coupling 60 and the motor shaft 54. The combination of the pin 70/rod 86 arrangement and the motor coupling block 68/motor shaft 54 arrangement provides a universal joint type of connection between the lift coupling 60 and the basket lift assembly 66. The plate 72 is coupled to the motor coupling block 68 such that the plate 72 rotates with the motor coupling block 68. The plate 72 also includes registry slots 76,78,80 for indicating rotating positions of the motor coupling block 68. The registry slots 76,78,80 form patterns or arrangements which can be detected by the sensors 62,64. For example, if the sensor 64 first detects a slot then the sensor 62 detects a slot, it indicates that the plate is rotated in a clockwise direction. Similarly, if the sensor 62 first detects a slot then the sensor 64 detects a slot, it indicates that the plate is rotated in a counter-clockwise direction. Since when the motor is driven in one direction the basket lift assembly extends, and when the motor is driven in the opposite direction the basket lift assembly retracts, the direction of rotation can be monitored by the two sensors 62,64. Further, since the distance of the longitudinal movement corresponds to turns of the plate, the length or position of the basket lift assembly can be monitored. Accordingly, the motor 44 can be in a resting or standby position after a certain distance is reached, e.g., when the basket lift 66 approaches the loading station 46. Similarly, the motor 44 can be in a resting or standby position when the basket lift 66 retracts to the staging station 48. Accordingly, extending/retracting of the basket lift assembly 66 is controlled.

It is appreciated that other types of registry patterns can be used on the plate within the scope and spirit of the present invention. It is also appreciated that the locations and numbers of sensors can be varied without departure from the present invention.

Figure 5:
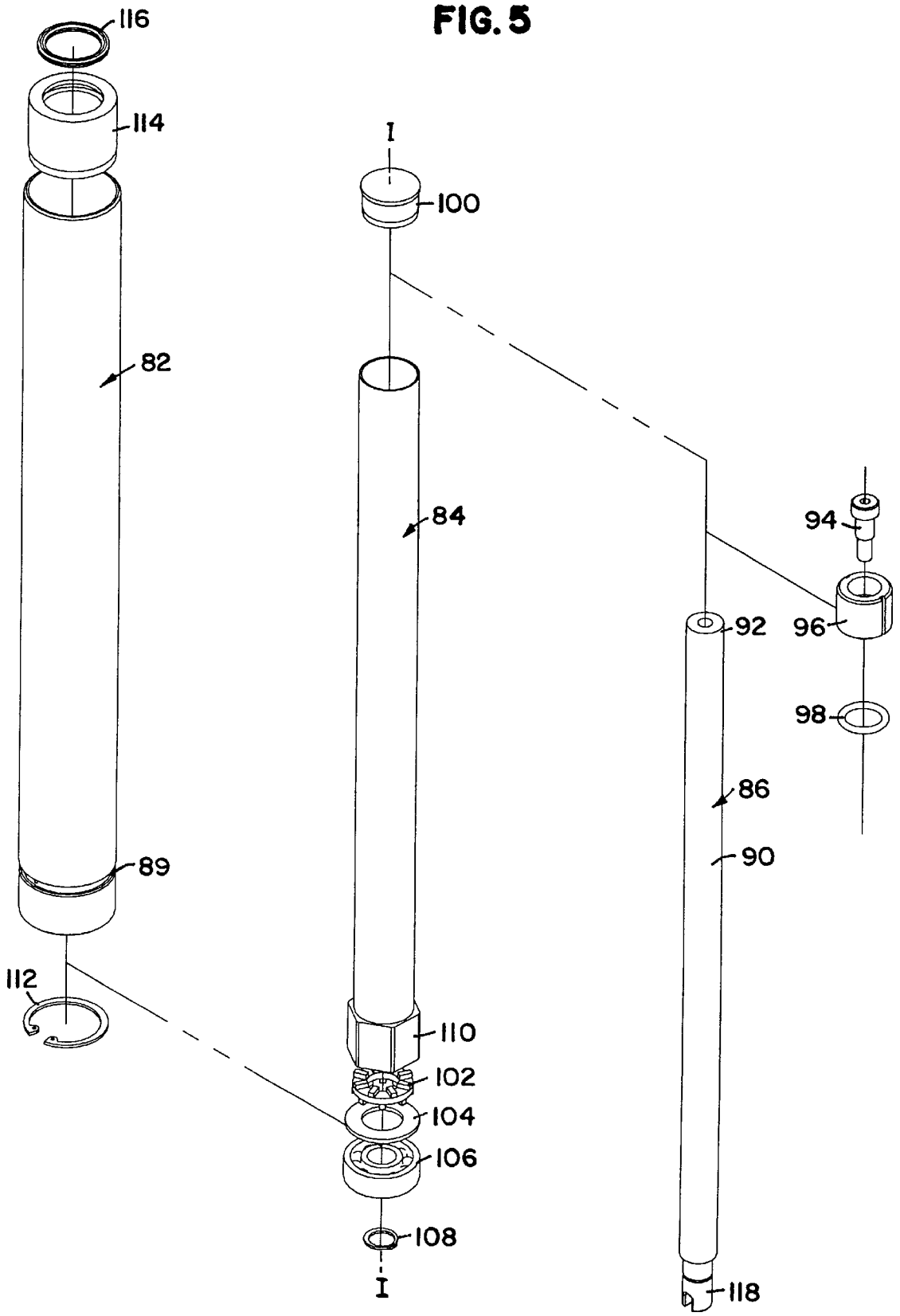
FIG. 5 is a partial, enlarged exploded view of one embodiment of a basket lift assembly of the basket lift in accordance with the present invention.
Figure 7:
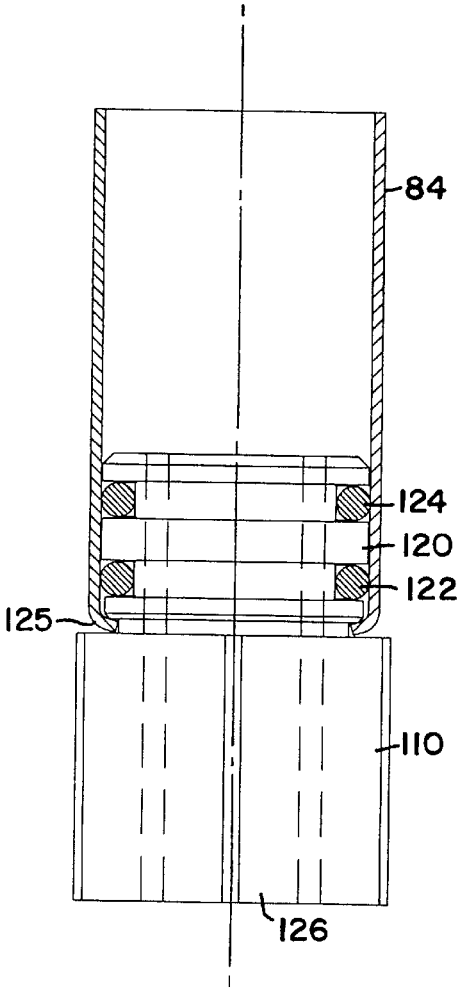
FIG. 7 is a partial, enlarged, cross-sectional view of the inner basket lift tube of the basket lift assembly of FIG. 6 in accordance with the present invention.

The basket lift assembly 66 as shown in FIG. 5 includes the outer basket lift tube 82, an inner basket lift tube 84, and an externally threaded rod 86. The inner basket lift tube 84 extends/retracts from/into the outer basket lift tube 82, and has an internally threaded member 110 disposed at the end of the inner basket lift tube 84. In one embodiment, the internally threaded member 110 is integral to the end of the inner basket lift tube 84. One alternative embodiment is that the member 110 is affixed onto the end of the tube 84. The member 110 has such a shape that the outer basket lift tube 82 prevents the inner basket lift tube 84 from rotating. The member 110 also has internal threads to correspond with external threads 90 extended along an outer wall 92 of the rod 86. In one embodiment, the member 110 has a hexagonal shape. It is appreciated that other types of shape, such as a pentagonal shape, etc., can be used within the principles of the invention. The outer basket lift tube 82 also provides a cleanable surface and a seal for food use.

Figure 8A:
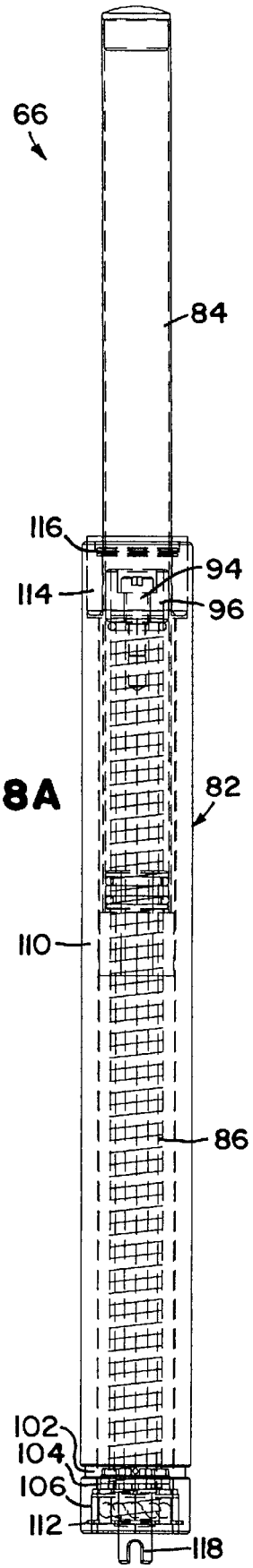
FIG. 8A is a cross-sectional view of the basket lift assembly in an extended position in accordance with the present invention.
Figure 8B:
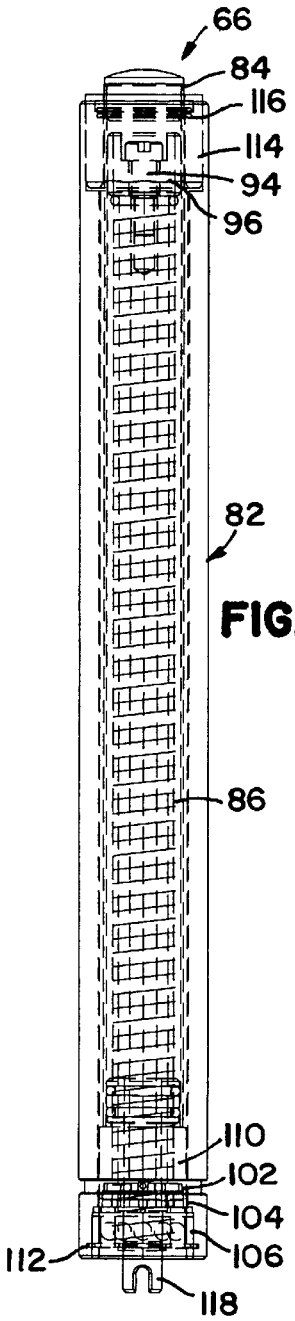
FIG. 8B is a cross-sectional view of the basket lift assembly in a retracted position in accordance with the present invention.

As shown in FIGS. 8A,8B, the externally threaded rod 86 is disposed inside the inner basket lift tube 84 which in turn is disposed inside the outer basket lift tube 82. In FIG. 8A, the basket lift assembly 66 is in an extended position, and in FIG. 8B, the basket lift assembly 66 is in a retracted position. As mentioned above, the member 110 is prevented from rotating with respect to the outer basket lift tube 82. Once the end of the rod 86 is rotated, the member 110 is forced to move up or down along the outer basket lift tube 82, depending on the direction of the rotation of the rod 86. In one direction, the member 110 and its attached tube 84 extend out of the outer basket lift tube 82 and in an opposite direction, the member 110 and its attached tube 84 retract into the outer basket lift tube 82. End 118 of the rod 86 projects out of the outer basket lift tube 82. The end 118 may have a U-shape, and the pin 70 of the lift coupling 60 is received inside the U-shape end 118, which allows a longitudinal and transversal clearance between the basket lift assembly 66 and the lift coupling 60 to significantly reduce binding due to eccentricity and/or misalignment between the externally threaded rod 86 and the motor shaft 54 and in turn significantly reduce damages thereto caused by the rotation of the motor 44.

Back in FIG. 5, at the top of the externally threaded rod 86, a screw 94 may retain a bearing 96. The top of the inner basket lift tube 84 receives a cap 100, which closes and seals the inner basket lift tube 84. The cap 100 also provides the contact point for the basket lift 38 to apply force to the basket carrier 36 when raising the basket carrier 36 to the loading station 46. A ring 102, a washer 104, a bearing 106, and a retaining ring 108 may be disposed below the member 110 and retained by a retaining ring 112 in the outer basket lift tube 82. Accordingly, the member 110 is prevented from moving out of the outer basket lift tube 82 at its bottom end. Further, a bearing 114 and a seal 116 may be disposed at the top end of the outer basket lift tube 82. Accordingly, the member 110 is prevented from moving out of the outer basket lift tube 82 at its top end.

Figure 6:
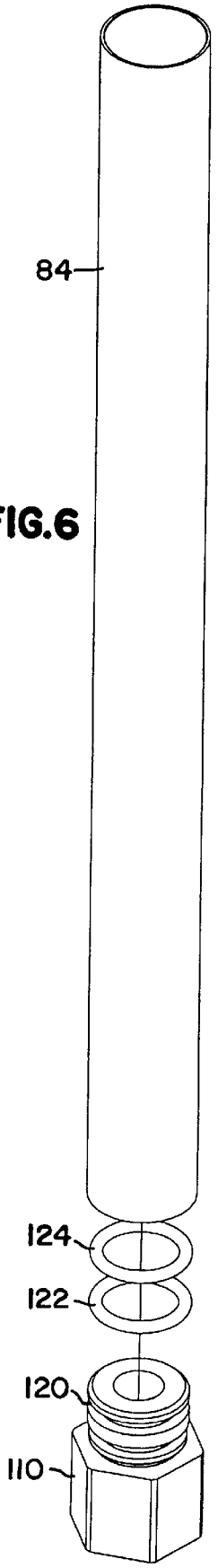
FIG. 6 is an exploded view of one embodiment of an inner basket lift tube of the basket lift assembly in accordance with the present invention.

As shown in FIG. 6, the member 110 may have a nut end 120 which is received at the bottom end of the inner basket lift tube 84. Two O-rings 122,124 are disposed between the nut end 120 and the bottom end of the inner basket lift tube 84. The inner basket lift tube 84 may have a curved end 125 which is locked in place at the joint of the hexagonal portion and the nut end of the member 110. The end of the externally threaded rod 86 extends through a bore 126 of the member 110.

It is appreciated to a person skilled in the art that other arrangements and parts can be used to extend/retract the inner basket lift tube 84 from/into the outer basket lift tube 82. Accordingly, upon rotation of the lift coupling 60 by the first electric motor 44, the externally threaded rod 86 drives the inner basket lift tube 84 to extend away from the staging station 48 and extend toward the loading station 46. Similarly, upon rotation of the lift coupling 60 by the first electric motor 44 in an opposite direction, the externally threaded rod 86 drives the inner basket lift tube 84 to retract from the loading station 46 and toward the staging station 48.

It is also appreciated that the parts and arrangements of the basket lift 38 can be varied within the principles of the invention.

Figure 9:
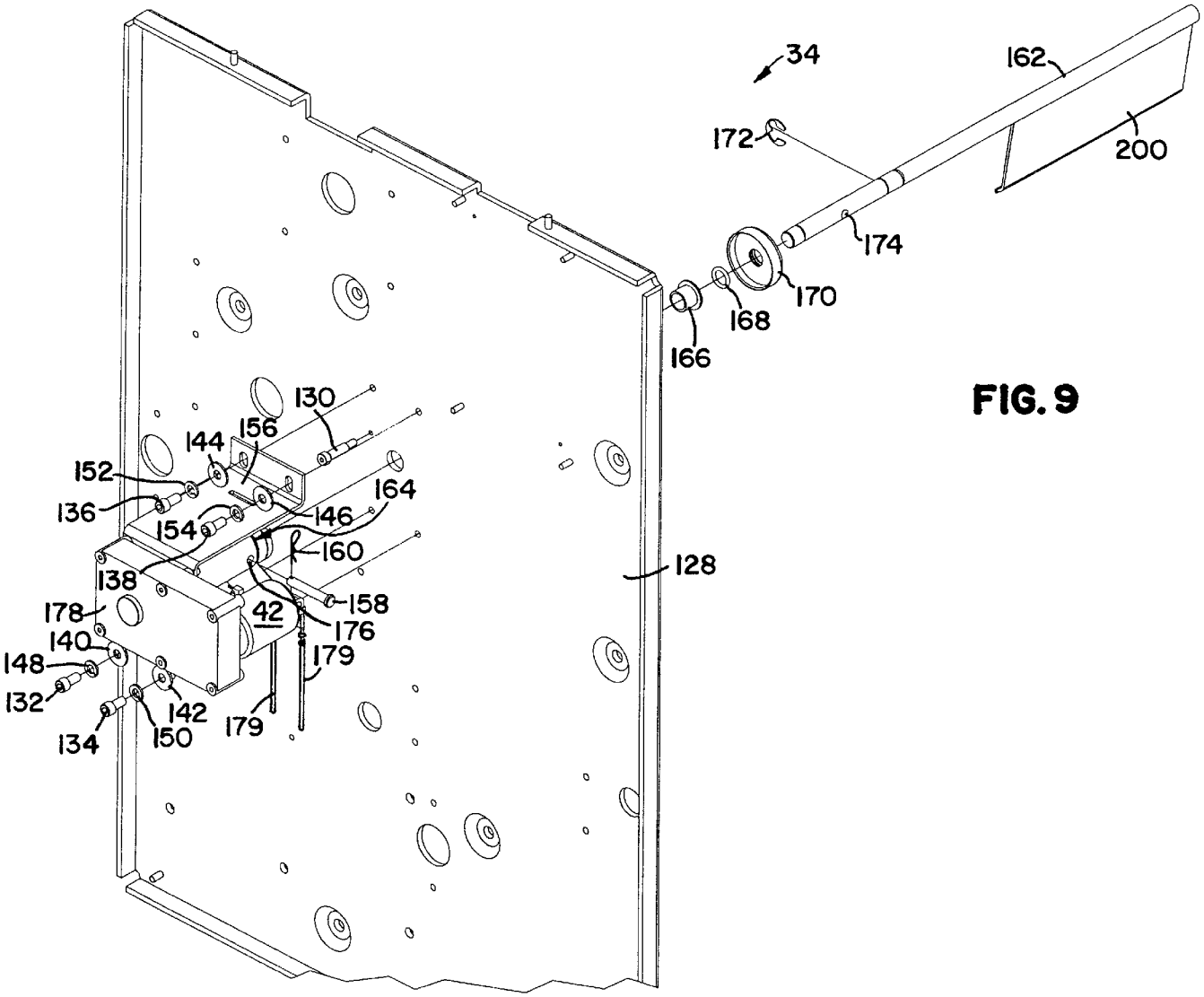
FIG. 9 is an exploded view of one embodiment of a stop gate mounted on a housing of the article dispenser unit in accordance with the present invention.

In FIG. 9, the stop gate 34 is mounted on a housing 128 of the dispenser unit 20. A screw 130 may be used as an obstacle for a hard stop disk 206 (in FIG. 12). The hard stop disk 206 stopped by the obstacle screw 130 which is disposed in a path of the hard stop disk 206 for providing an initial or home position of a stop gate tube assembly 164 (see FIG. 12). The hard stop disk 206 and the obstacle screw 130 may be replaced by a sensor for indicating the initial or home position of the stop gate tube assembly 164. The hard stop disk 206 and the obstacle screw 130 may also provide a hard stop for the excessive rotation of the stop gate tube assembly 164.

Screws 132,134,136,138 and washers 140,142,144,146, 148,150,152,154 may be used to mount a housing 156 of the stop gate 34 onto the housing 128 of the unit 20. A pin 158 and a retaining pin 160 may be used to lock a stop gate shaft 162 in a stop gate tube assembly 164 (see also in FIG. 12). A bearing 166, an O-ring 168, and a shaft collar 170 may be used to retain at one end of the stop gate tube assembly 164. The stop gate shaft 162 extends through the shaft collar 170, the O-ring 168, the bearing 166, the housing 128, and into the stop gate tube assembly 164. A retainer clip 172 may be used to lock the shaft 162. A hole 174 is aligned with a hole 176 on the stop gate tube assembly 164, which receives the pin 158 which is held in place by the pin 160.

Figure 10:
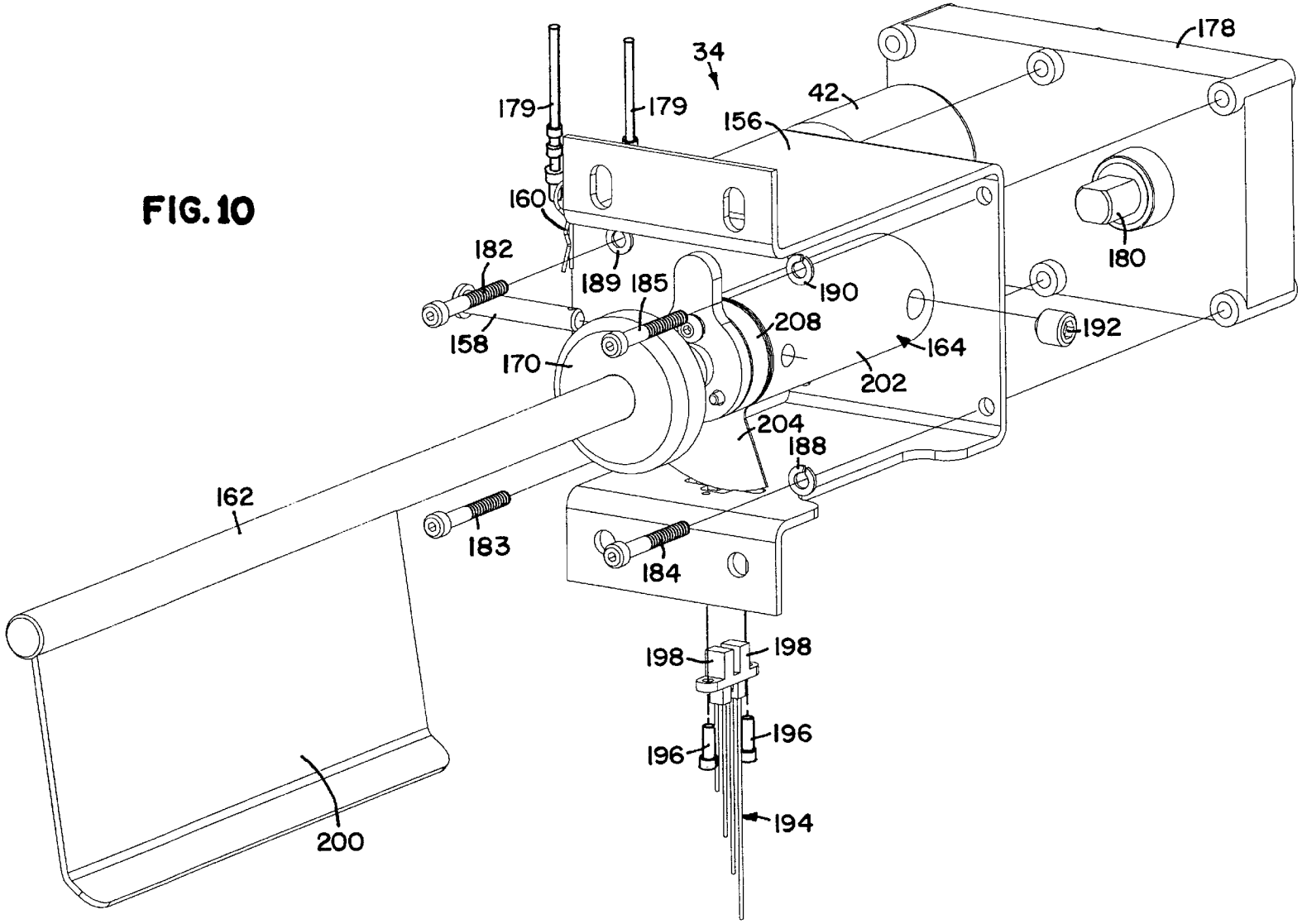
FIG. 10 is an exploded view of one embodiment of the stop gate in accordance with the present invention.
Figure 11:
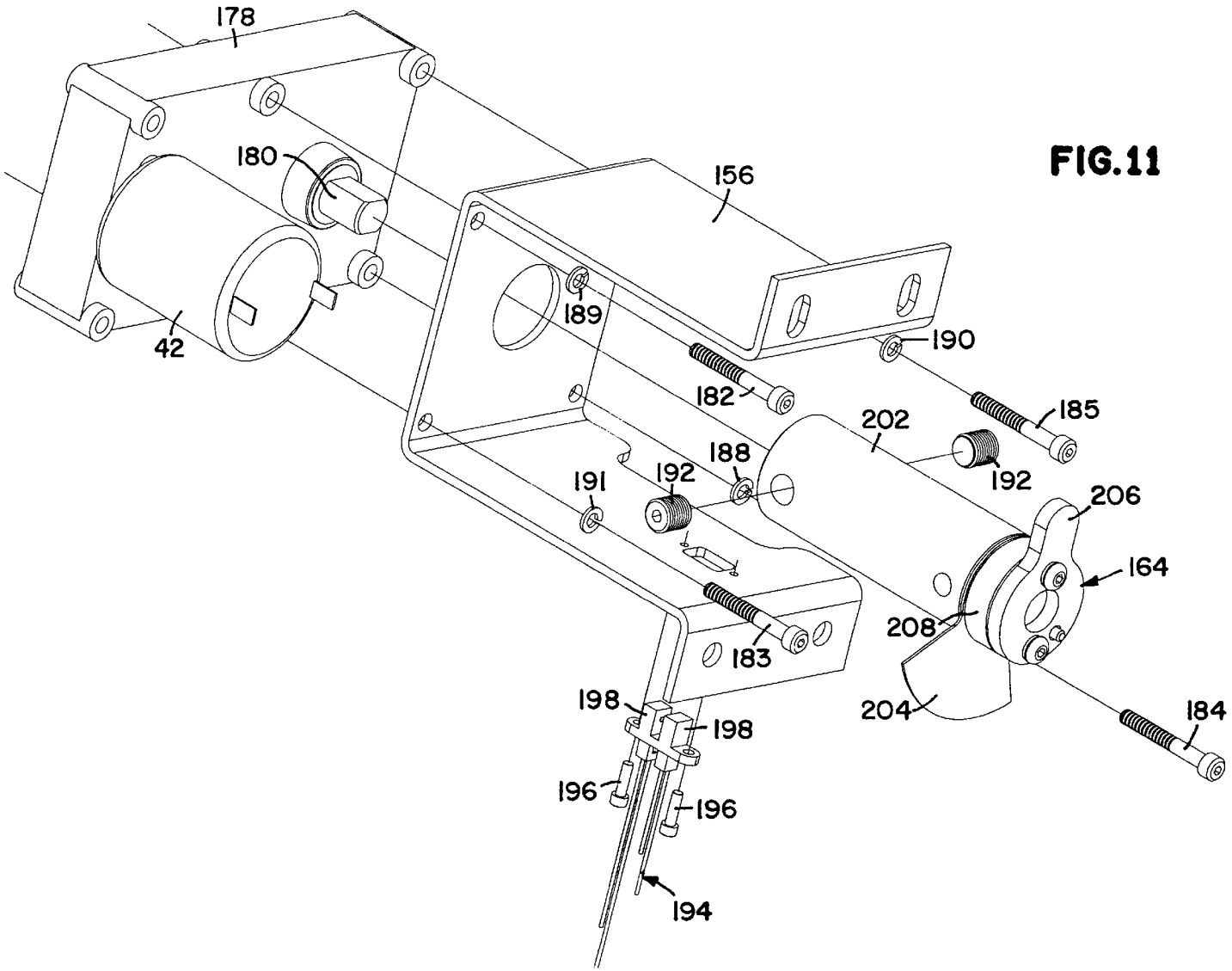
FIG. 11 is a partial, enlarged exploded view of one embodiment of the stop gate of FIG. 10.

In FIGS. 9, 10, and 11, the electric motor 42 is connected to a gear box 178. A pair of wiring harness 179 bring the electricity to the motor 42. A motor shaft 180 is secured in the stop gate tube assembly 164 such that when the motor shaft 180 rotates, the stop gate tube assembly 164 rotates accordingly. As also shown in FIGS. 10 and 11, screws 182,183,184,185 and washers 188,189,190,191 are used to mount the stop gate housing 156 onto the motor gear box 178. A set of screws 192 are used to hold the tube assembly 164 onto the motor shaft 180. Further, a sensor 194 is mounted onto the housing 156 by a set of screws 196. The sensor 194 can be various types of sensors within the scope and spirit of the present invention. For example, an optical encoder type of sensor can be used whereby a set of optical encoders 198 are disposed at the head of the sensor 194. It is also appreciated that the sensors can be mounted onto the housing or other parts of the unit 20 without departure from the invention.

Further in FIGS. 9 and 10, a stop gate flap 200 is disposed at the end of the stop gate shaft 162. When the motor 42 activates in one direction, the flap 200 can be rotated to a close position to hold empty basket(s). When the motor 42 activates in an opposite direction, the flap 200 can be rotated to an open position to release empty baskets, one of which is slid down onto the basket carrier 36 (in FIG. 1). The motor 42 may be a DC motor known in the motor art. The ratio of the gear box 178 with respect to the motor driver is selected to minimize back driving of the motor shaft and to allow the stop gate flap 200 to hold the empty baskets in the close position without any power to the motor 42. Accordingly, the stop gate 34 can be rotated to the close position to hold the empty basket(s) in line. The empty baskets can move down the ramp 32 (in FIG. 1) by gravity or by other conveying apparatus. It is appreciated that the ramp 32 may be in horizontal or even inclined against moving toward the loading station 46 by gravity without departure from the principles of the invention. In addition, in one embodiment, all empty baskets may be released at once, and the space between the basket in the basket carrier and the second basket prevents more than one basket from getting through the opened stop gate 34. In this case, once a request-to-fill signal is received, the stop gate 34 may be closed to hold the second empty basket and the following baskets. It is appreciated that other arrangements of holding the baskets can be made without departure from the scope of the invention.

Figure 12:
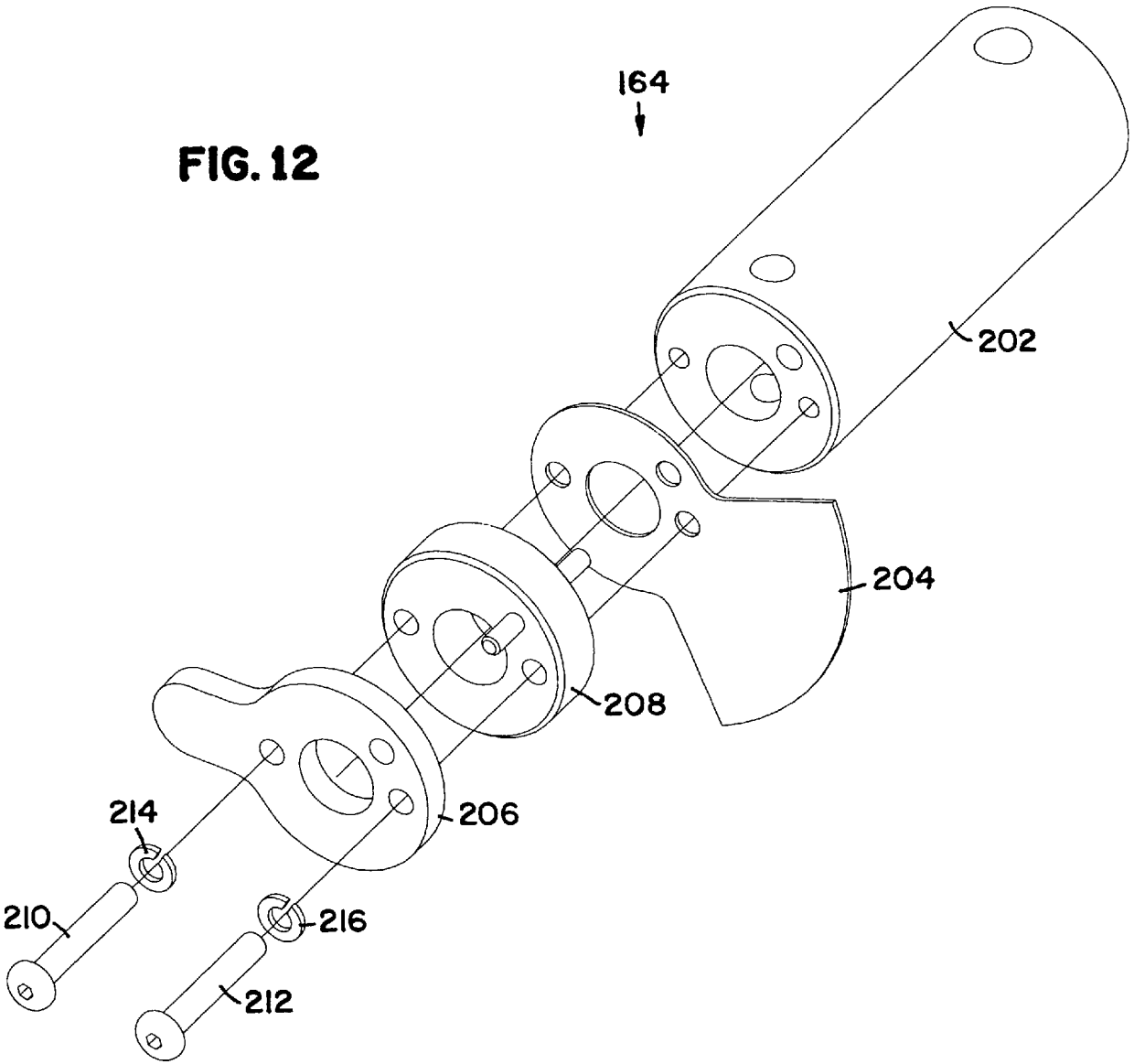
FIG. 12 is an exploded view of one embodiment of a stop gate tube assembly in accordance with the present invention.

In FIG. 12, it is shown that the stop gate tube assembly 164 includes a tube 202, a plate 204, and the hard stop disk 206. A spacer 208 may be disposed between the plate 204 and the hard stop disk 206. One end of the tube 202 encloses the motor shaft 180, and the stop gate shaft 162 is connected to the motor shaft 180 in the tube 202. The plate 204 has a fan shape on one side which provides an indicator for indicating rotating positions of the stop gate tube assembly 164, such that the positions of the flap 200 are monitored. The hard stop disk 206 has an extended section on one side. The extended section hits the obstacle screw 130 (see FIG. 9). Accordingly, the rotation of the flap 200 is further controlled. The hard stop disk 206 provides a means for the stop gate tube assembly 164 to orient itself in a home or initial position without interaction by the user. The plate 204, the hard stop disk 206, and the spacer 208 may be mounted at one end of the tube 202 by screws 210,212 and washers 214,216.

It is appreciated that other parts and arrangements of the stop gate 34 can be used without departure from the principles of the present invention.

Figure 13:
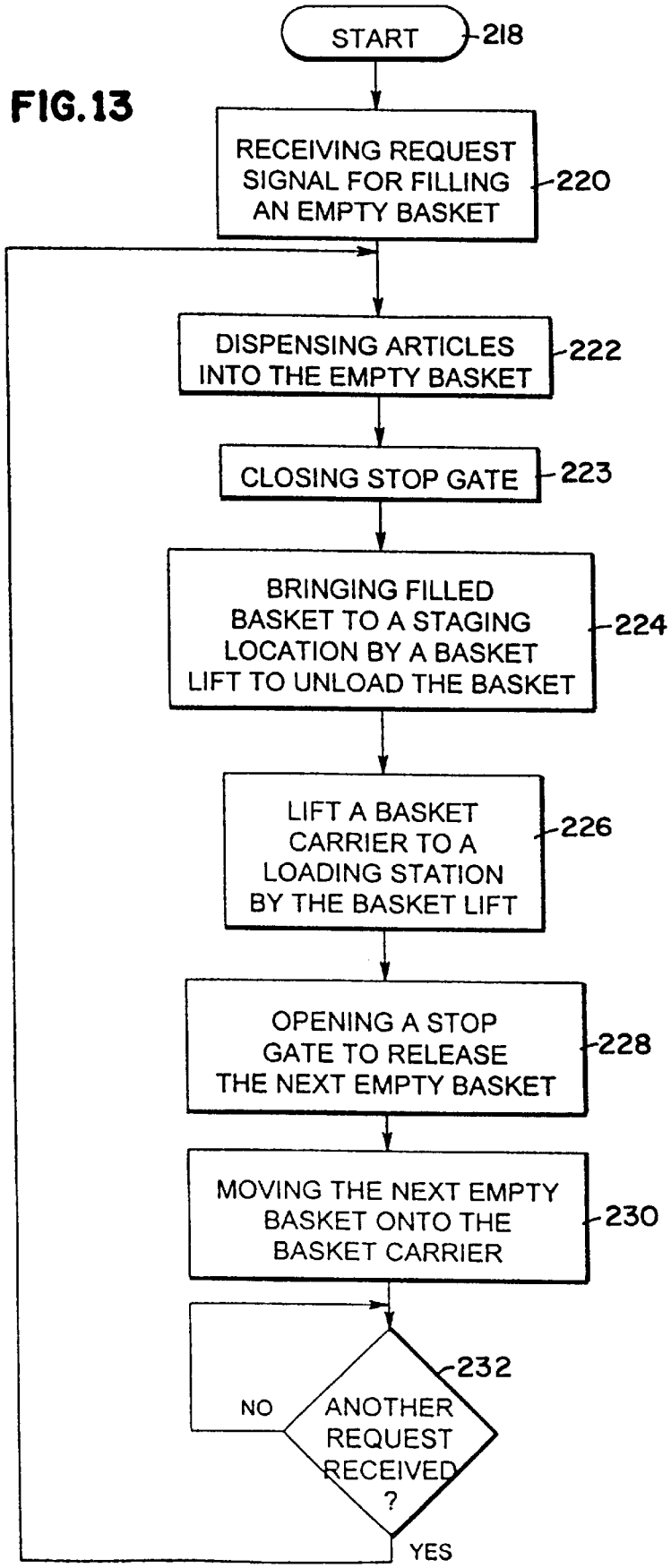
FIG. 13 is a flow chart of one embodiment of an article dispensing and basket movement controlling operation in accordance with the present invention.

FIG. 13 illustrates an exemplary article dispensing and basket movement controlling operation in accordance with the present invention. It is appreciated that FIG. 13 is only for illustration, not for limitation. The filling basket operation starts in box 218. A first sensor set, e.g. sensors 62,64, indicates that the basket lift is up in the loading station, and a third sensor set, e.g. an upper guide sensor 234 (see FIG. 1) indicates that a basket is in the basket carrier. Upon receiving a request signal for filling an empty basket, in box 220, which can be an automatic sensing of an empty basket or a user request, articles are dispensed into the empty basket in box 222. After the articles have been transferred to the basket, the stop gate closes in box 223. A second sensor set, e.g. sensor 194, indicates that the stop gate is closed. The electric motor 44 is activated to rotate the externally threaded rod 86 in one direction, and the basket lift 38 lowers the basket carrier 36 from the loading station 46 to the staging station 48 to unload the basket in box 224. The first sensor set indicates that the basket lift moves down to the staging station, and a fourth sensor set, e.g. a lower guide sensor 236, indicates whether a previously filled basket is present such that the currently filled basket cannot be transferred onto the ramp 40. If the filled basket cannot yet be transferred onto the ramp 40, the basket lift will not be lifted. If the fourth sensor set indicates that the filled basket can be transferred onto the ramp 40 and it senses that the filled basket has been transferred to the ramp 40, the electric motor 44 is activated to rotate the externally threaded rod 86 in an opposite direction, and the basket lift 38 lifts the basket carrier 36 back to the loading station 46 in box 226. The first sensor set indicates that the basket lift moves up to the loading station, and the third sensor set indicates that no basket is on the basket carrier. The stop gate 34 opens the flap 200 to release the empty baskets in box 228. The second sensor set indicates that the stop gate is open. One basket on the ramp 32 is then moved down and onto the basket carrier 36 in box 230. The third sensor set indicates that a basket is present in the basket carrier. Next, this basket can be filled in the same operation cycle upon receiving another request.

It is appreciated that the third and fourth sensor sets 234,236 can be any type of suitable sensors in the sensor art, for example, a photoelectric sensor.

Figure 14:
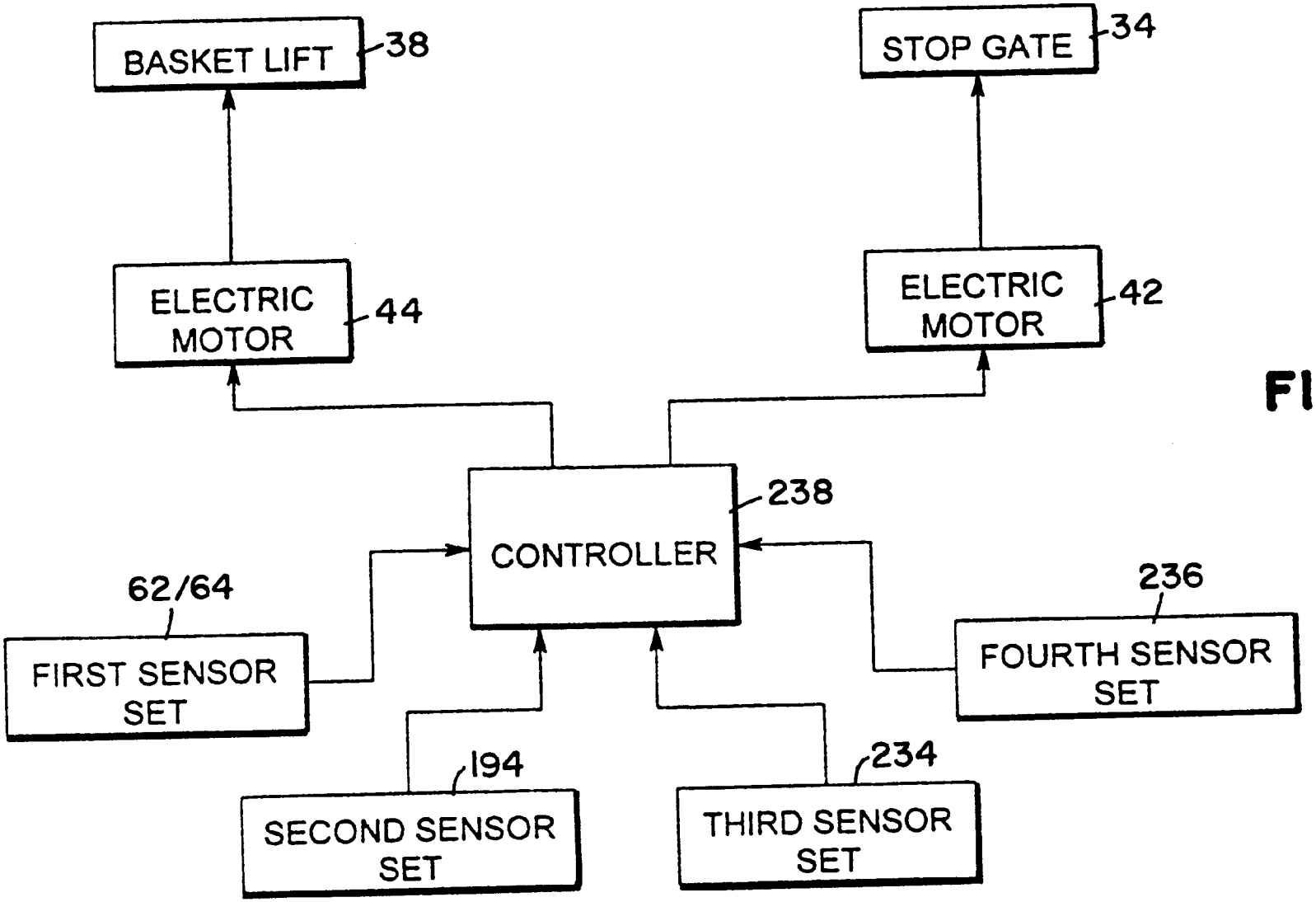
FIG. 14 is a block diagram of one embodiment of a sensor/controller apparatus in accordance with the present invention.

The activation of the electric motors and the operation of other parts of the dispensing unit are controlled by a controller. FIG. 14 illustrates a functional block diagram of a controller 238 controlling the electric motors 42,44 based on the signals from the corresponding sensor set. It is appreciated that other configurations and arrangements can be used in accordance with the principles of the present invention.

The exemplary sequence of operations for dispensing fries from the unit 20 from an initial power up condition to a normal operation condition is described in the following table, which is only for illustration, not for limitation. The exemplary conditions of the unit 20 is as follows:

1. A hopper 10 (in FIG. 1) is fully loaded with product, such as fries, and properly installed on the dispenser unit 20.

2. There are two empty baskets on the Upper Guide or loading ramp.
3. There are no empty baskets on the Lower Guide or staging ramp.
4. A dispenser load switch 12 (in FIG. 1) is in the 1.0 Lb position.

| Event | Response |
|---|---|
| Power Switch Turned ON | Stop gate closes to assume the home position. The basket lift goes down to find the down, home position and then raises to the full up position. |
| Dispensing Begins. | Fries are now dispensed from the hopper to the accumulator door(s). |
| Drum Motor turns. | The accumulator door(s) weigh the fries and signal to stop the drum motor when the 1.0 Lb. weight is attained. |
| Stop gate opens. | Once the weight is attained, the stop gate opens to allow a basket to slide into the basket carrier or saddle to receive the pre-weighted fry load. |
| Accumulator doors open and empty. | The accumulator doors now open to drop the fries into the waiting basket. The waiting basket is detected by a photoelectric sensor in the chassis of the dispenser unit. If no basket is present, the accumulator doors will not open. |
| Stop gate closes | The stop gate again closes to allow clearance of the filled basket in the basket lift. |
| Basket lift lowers basket. | The basket lift lowers the filled basket to the lower guide or ramp. As the filled basket slides down the lower guide, another photoelectric sensor acknowledges the basket leaving the lift and permits the basket lift to raise again. |
| Basket lift goes back up. | The basket lift raises to the up position in preparation for the next basket. |
| Stop gate opens. | Stop gate opens again, permitting the next empty basket to slide into the basket carrier for filling. |
| Restart of Dispensing. | Cycle starts all over again. Dispensing Begins. After filling the second basket, the dispenser will stop because there will be no basket detected in the basket carrier for filling. |

The time for one typical basketing cycle under the above conditions is typically 4–6 seconds. It is appreciated that the time for one basketing cycle can be varied within the scope of the invention.

It is appreciated that the steps or sequences of the above operation can be adjusted within the scope of the present invention. For example, the basket carrier may be initially positioned in the staging station or a position between the staging station and the loading station. Further, for example, the stop gate may be initially positioned in a holding position or a position between the holding position and the releasing position. It is also appreciated that other dispensing and controlling operations can be used to release, lift, fill, unlift a basket within the principles of the present invention.

While a particular embodiment of the invention has been described with respect to its application for moving baskets and dispensing articles, it will be understood by those of skill in the art that the invention is not limited by such application or embodiment for the particular components disclosed and described herein. It will be appreciated by those skilled in the art that other configurations that embody the principles of this invention and other applications therefor can be configured within the spirit and intent of this invention. The configuration described herein is provided as only example(s) of an embodiment(s) that incorporate(s) and practice(s) the principles of this invention. Other modifications and alterations are well within the knowledge of those skilled in the art and are to be included within the broad scope of the appended claims.

We claim:

1. An electrically controlled apparatus for filling at least one basket, comprising:

a) an electrically driven stop gate, wherein one basket can be held/released by the stop gate;

b) a first sensor set and a controller determining whether the stop gate opens or closes;

c) a second sensor set and the controller determining a position of the stop gate;

d) an electrically driven basket lift, wherein a basket carrier can be lifted/lowered by the basket lift between a loading station, whereby an empty basket released by the stop gate and carried by the basket carrier can be filled, and a staging station, whereby a filled basket carried by the basket carrier can be removed;

e) a third sensor set and the controller determining whether the articles should be dispensed; and f) a fourth sensor set and the controller determining whether the basket carrier should be lifted from the staging station to the loading station.

2. The apparatus of claim 1, wherein the first sensor set comprises two sensors, the first sensor set indicates positions of the basket lift.

3. The apparatus of claim 1, wherein the second sensor set comprises one sensor, the second sensor set indicates positions of the stop gate.

4. The apparatus of claim 1, wherein the third sensor set comprises one sensor, the third sensor set indicates whether one basket is in the basket carrier at the loading station.

5. The apparatus of claim 1, wherein the fourth sensor set comprises one sensor, the fourth sensor set indicates whether one filled basket should be conveyed away from the staging station and has been conveyed away from the staging station.

6. The apparatus of claim 1, wherein:

the basket lift is driven by a first electric motor, the basket lift lowers/lifts the basket carrier to the staging station/loading station;

the stop gate is driven by a second electric motor, the stop gate releases/holds the one basket, the one basket being moved onto the basket carrier and the articles being dispensed in the one basket, the basket lift lowers filled basket from the loading station to the staging station; and the first and second electric motors are controlled by the controller.

7. The apparatus of claim 6, wherein the basket lift comprises:

a lift base, the first electric motor is mounted on the lift base;

a lift coupling mounted on and rotatable by the first electric motor; and an extendable/retractable basket lift assembly connected to the lift coupling, such that when the first electric motor is activated in one direction, the basket lift assembly is extended to lift the basket carrier to the loading station, and that when the first electric motor is activated in an opposite direction, the basket lift assembly is retracted to lower the basket carrier to the staging station.

8. The apparatus of claim 7, wherein the basket lift assembly comprises:

an outer basket lift tube;

an inner basket lift tube, extended/retracted from/into the outer basket lift tube, having an internally threaded member; and an externally threaded rod having threads corresponding to threads of the internally threaded member;

wherein the externally threaded rod is rotated by the first electric motor, the internally threaded member having a shape which prevents the internally threaded member and the inner basket lift tube from rotating with respect to the outer basket lift tube, such that when the externally threaded rod is rotated, the internally threaded member and the inner basket lift tube are forced to move along the outer basket lift tube so as to raise and lower the basket carrier.

9. The apparatus of claim 8, wherein the externally threaded rod has one end extended out of the basket lift assembly and connected to the lift coupling, such that upon rotation of the lift coupling by the first electric motor in one direction, the externally threaded rod drives the inner basket lift tube to extend toward the loading station, and upon rotation of the lift coupling by the first electric motor in an opposite direction, the externally threaded rod drives the inner basket lift tube to retract toward the staging station.

10. The apparatus of claim 7, wherein the lift coupling includes:

a motor coupling block having a bore to retain a motor shaft of the first electric motor;

a pin disposed across walls of the bore of the motor coupling block, the pin being received by an end of the basket lift assembly; and a plate coupled to the motor coupling block such that the plate rotates with the motor coupling block, the plate having an indicator signifying a rotating position of the motor coupling block.

11. The apparatus of claim 10, wherein the end of the basket lift assembly is in a U-shape which receives the pin of the lift coupling.

12. The apparatus of claim 7, wherein the basket lift further comprises a housing which retains the lift coupling, one end of the basket lift assembly, and the first sensor set.

13. The apparatus of claim 12, wherein the basket lift further includes a lock assembly detachably locks the basket lift assembly with respect to the housing.

14. The apparatus of claim 13, wherein the lock assembly is in a bent shape with one section mounted on the housing, and the other section having a V-shape which allows the lock assembly to contact an outer groove of the basket lift assembly.

15. The apparatus of claim 6, wherein the stop gate comprises:

a stop gate shaft being connected to the second electric motor;

a stop gate flap holding/releasing the at least one empty basket, the stop gate flap being rotatable between a holding position and a releasing position; and a stop gate tube assembly retaining the stop gate shaft and a motor shaft of the second electric motor.

16. The apparatus of claim 15, wherein the stop gate tube assembly comprises:

a tube retaining the stop gate flap;

a plate having an indicator signifying a rotating position of the stop gate tube assembly; and a hard stop disk stopped by an obstacle which indicates a home position of the stop gate assembly, the plate and the hard stop disk being mounted on the tube.

17. The apparatus of claim 15, wherein the stop gate comprises a housing which retains the stop gate tube assembly, the motor shaft of the second electric motor, and the second sensor set.

18. A method of filling at least one empty basket with articles upon a request signal, comprising:

a) receiving the request signal;

b) dispensing the articles into one empty basket at an article loading station;

c) closing a stop gate driven by a second electric motor;

d) lowering filled basket seated on a basket carrier from a loading station to a staging station by a basket lift driven by a first electric motor;

e) lifting the basket carrier by the basket lift, driven by the first electric motor, back to the loading station;

f) opening the stop gate driven by the second electric motor to release next empty basket; and g) moving the next empty basket onto the basket carrier to be filled.

19. The method of claim 18, further comprising h) conveying the filled basket away.

20. The method of claim 19, wherein the filled basket is conveyed away by a staging conveyor.

21. The method of claim 19, wherein the filled basket is conveyed away manually by hand.

22. The method of claim 19, the method further comprising i) determining whether another request signal is received, if received, continuing b)–g).

* * * * *